US009004932B2

(12) United States Patent
Inoue

(10) Patent No.: US 9,004,932 B2
(45) Date of Patent: Apr. 14, 2015

(54) CONNECTOR HAVING A SEALING RING WITH PROJECTIONS POSITIONED IN RECESSES ON AN INNER PERIPHERY OF A TUBULAR FITTING

(71) Applicant: Sumitomo Wiring Systems, Ltd., Yokkaichi, Mie (JP)

(72) Inventor: Hiroshi Inoue, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 14/024,291

(22) Filed: Sep. 11, 2013

(65) Prior Publication Data

US 2014/0080340 A1 Mar. 20, 2014

(30) Foreign Application Priority Data

Sep. 18, 2012 (JP) ..... 2012-203922

(51) Int. Cl.
*H01R 13/52* (2006.01)

(52) U.S. Cl.
CPC ..... *H01R 13/5202* (2013.01)

(58) Field of Classification Search
USPC ..... 439/271–275, 587
See application file for complete search history.

(56) References Cited

U.S. PATENT DOCUMENTS

| | | | | |
|---|---|---|---|---|
| 6,520,788 | B2 * | 2/2003 | Ichida et al. | 439/271 |
| 7,029,328 | B1 * | 4/2006 | Mckenzie et al. | 439/587 |
| 7,922,530 | B2 * | 4/2011 | Chazottes et al. | 439/587 |
| 2011/0300731 | A1 * | 12/2011 | Nakamura | 439/271 |
| 2014/0213088 | A1 * | 7/2014 | Furuya et al. | 439/271 |
| 2014/0213089 | A1 * | 7/2014 | Ueberschlag | 439/271 |

FOREIGN PATENT DOCUMENTS

JP 2006-147474 6/2006

* cited by examiner

*Primary Examiner* — Chandrika Prasad
(74) *Attorney, Agent, or Firm* — Gerald E. Hespos; Michael J. Porco; Matthew T. Hespos

(57) ABSTRACT

A connector includes a housing (10) with a terminal accommodating portion (11) having a non-circular outer periphery and a tubular fitting (12) surrounding the terminal accommodating portion (11). A seal ring (30) is mounted on the outer periphery of the terminal accommodating portion (11) in the tubular fitting (12). Positioning projections (32) are formed on the seal ring (30), and positioning recesses (26) are formed on the inner periphery of a front end part of the tubular fitting portion (12) for engaging the positioning projections (32) at an initial stage of mounting the seal ring (30) and positioning the seal ring (30) in a circumferential direction by being.

7 Claims, 7 Drawing Sheets

CONNECTOR HAVING A SEALING RING WITH PROJECTIONS POSITIONED IN RECESSES ON AN INNER PERIPHERY OF A TUBULAR FITTING

BACKGROUND OF THE INVENTION

1. Field of the Invention

The invention relates to a connector.

2. Description of the Related Art

Japanese Unexamined Patent Publication No. 2006-147474 discloses a waterproof connector with a housing that has a terminal accommodating portion surrounded by a tubular fitting. A seal ring is mounted on the outer periphery of the terminal accommodating portion in the tubular fitting portion.

The outer periphery of the terminal accommodating portion is non-circular, hence the seal ring is also non-circular. Thus, if the seal ring is mounted on the terminal accommodating portion while being displaced in a circumferential direction, the amount of resilient deformation of the seal ring may become nonuniform in the circumferential direction and sealing performance may be reduced.

The invention was completed based on the above situation and an object thereof is to prevent a reduction in sealing performance.

SUMMARY OF THE INVENTION

The invention relates to a connector with a housing that has a terminal accommodating portion. The terminal accommodating portion has a non-circular outer periphery and is surrounded by a tubular fitting. A seal ring is to be accommodated in the tubular fitting from the front of the housing and is mounted on the outer periphery of the terminal accommodating portion. A positioning portion is formed on the seal ring, and a positioning recess is formed on the inner periphery of a front end part of the tubular fitting. The positioning recess is configured to position the seal ring in a circumferential direction by engaging the positioning portion at an initial stage of mounting the seal ring. More particularly, the positioning portion fits into the positioning recess at an initial stage of mounting the seal ring and positions the seal ring in the circumferential direction. Thus, there is no reduction in sealing performance due to a displacement of the seal ring in the circumferential direction. Further, the seal ring is located near the front end of the tubular fitting at the initial mounting stage. Thus, visual position confirmation and positioning are easy and operability is excellent.

The seal ring may include a ring-shaped seal functioning portion to be held in close contact with the outer peripheral surface of the terminal accommodating portion, and a positional relationship between the positioning portion and the positioning recess may be set so that the positioning portion is fit into the positioning recess before the seal functioning portion contacts the outer periphery of the terminal accommodating portion in the mounting process of the seal ring. According to this configuration, the entire seal ring already is positioned in the circumferential direction when the seal functioning portion is mounted on the outer periphery of the terminal accommodating portion. Thus, it is not necessary to correct the position of the seal ring in the circumferential direction after the seal functioning portion is mounted on the terminal accommodating portion.

The connector may include a rear wall connecting a rear part of the tubular fitting to the outer periphery of the terminal accommodating portion. A holding portion may be formed on the rear wall and configured to hold the seal ring in a mounted state by being engaged with the positioning portion. According to this configuration, the positioning portion also has a function of holding the seal ring in the mounted state. Thus, the shape of the seal ring can be simplified as compared with the case where a special means for holding the seal ring in the mounted state is formed in addition to the positioning portion.

DETAILED DESCRIPTION OF THE PREFERRED EMBODIMENTS

Figure 1:
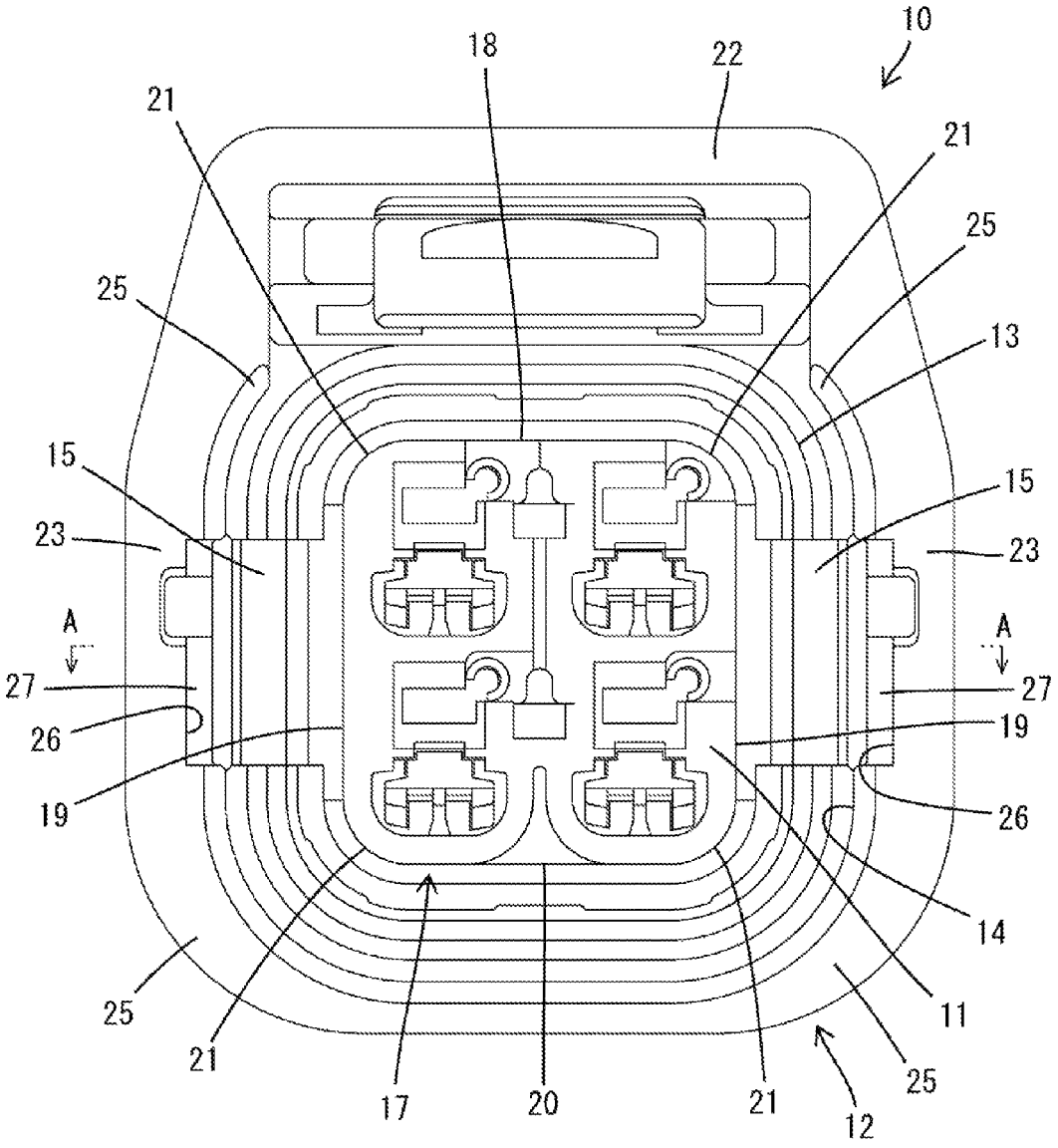
FIG. 1 is a front view of a housing in accordance with an embodiment of the invention.
Figure 2:
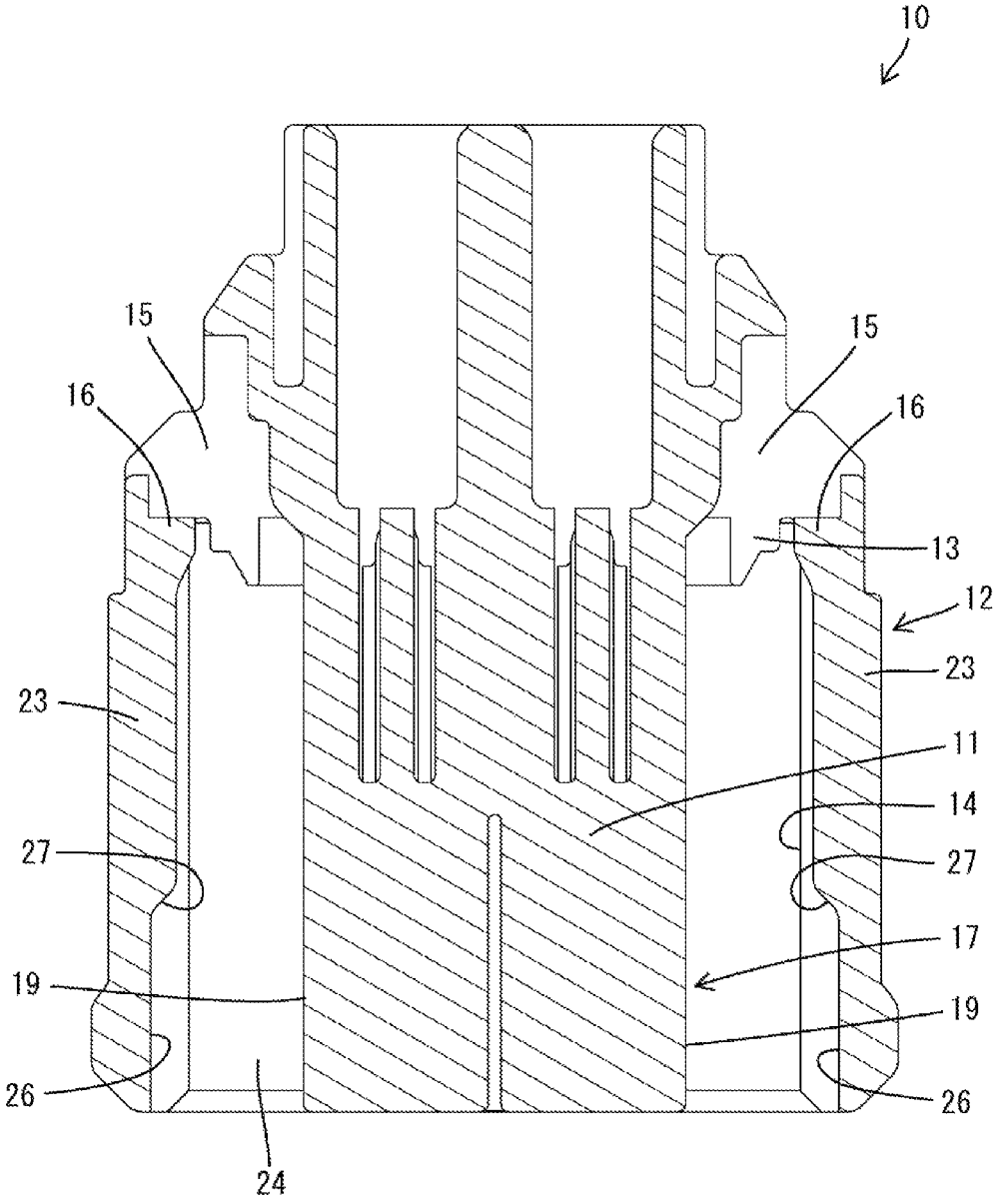
FIG. 2 is a section along A-A of FIG. 1.

One specific embodiment of the invention is described with reference to FIGS. 1 to 8. A connector of this embodiment is composed of a housing 10 and a seal ring 30. The housing 10 is made of synthetic resin and an integral assembly of a block-shaped terminal accommodating portion 11 and a tubular fitting 12 surrounding the terminal accommodating portion 11 over the entire periphery, as shown in FIGS. 1 and 2. Terminal fittings (not shown) are to be accommodated in the terminal accommodating portion 11.

As shown in FIG. 2, a rear part of the tubular fitting 12 is connected to a rear end part of the outer periphery of the terminal accommodating portion 11 via a rear wall 13 over the entire periphery. A ring-shaped clearance between the outer periphery of the terminal accommodating portion 11 and the inner periphery of the tubular fitting portion 12 to form a forwardly open connection space 14. A receptacle of a mating connector (not shown) is fit into this connection space 14 from the front. The rear wall 13 is formed with left and right holding portions 15. The holding portions 15 are in the form of holes penetrating from the front surface to the rear surface of the rear wall 13. Locking portions 16 facing backward are formed by recessing inner side surfaces of the holding portions 15.

As shown in FIG. 1, the outer peripheral surface of the terminal accommodating portion 11 defines a non-circular sealing surface 17. The sealing surface 17 is the outer peripheral surface of the terminal accommodating portion 11 and is composed of a flat upper surface 18, flat left and right side surfaces 19, a flat lower surface 20 and four arcuate surfaces 21 having a quarter-circular shape and smoothly connecting the four flat surfaces 18, 19 and 20.

The tubular fitting 12 faces the sealing surface 17 of the terminal accommodating portion 11 with a substantially uniform clearance therebetween. Thus, the front shape of the tubular fitting 12 is non-circular similar to the sealing surface 17 of the terminal accommodating portion 11. The tubular fitting 12 is composed of an flat upper wall 22, flat left and right side walls 23, a flat lower wall 24 and four arcuate walls 25 having substantially quarter-circular shapes and connecting the flat walls 22, 23 and 24.

As shown in FIGS. 1 and 2, the tubular fitting 12 has two bilaterally symmetric positioning recesses 26 for positioning the seal ring 30. The positioning recesses 26 are grooves formed by recessing the inner peripheries of front end parts of the both left and right side walls 23. The positioning recesses 26 open on the front end surface of the tubular fitting 12. Further, formation areas of the positioning recesses 26 in forward and backward directions (directions parallel to a mounting direction of the seal ring 30 onto the terminal accommodating portion 11) are only front end parts of the tubular fitting 12. Guiding slants 27 are formed on rear end parts of the positioning recesses 26 and are oblique to forward and backward directions. Front ends of the tubular fitting 12 and the terminal accommodating portion 11 are located substantially at the same position in forward and backward directions.

Figure 6:
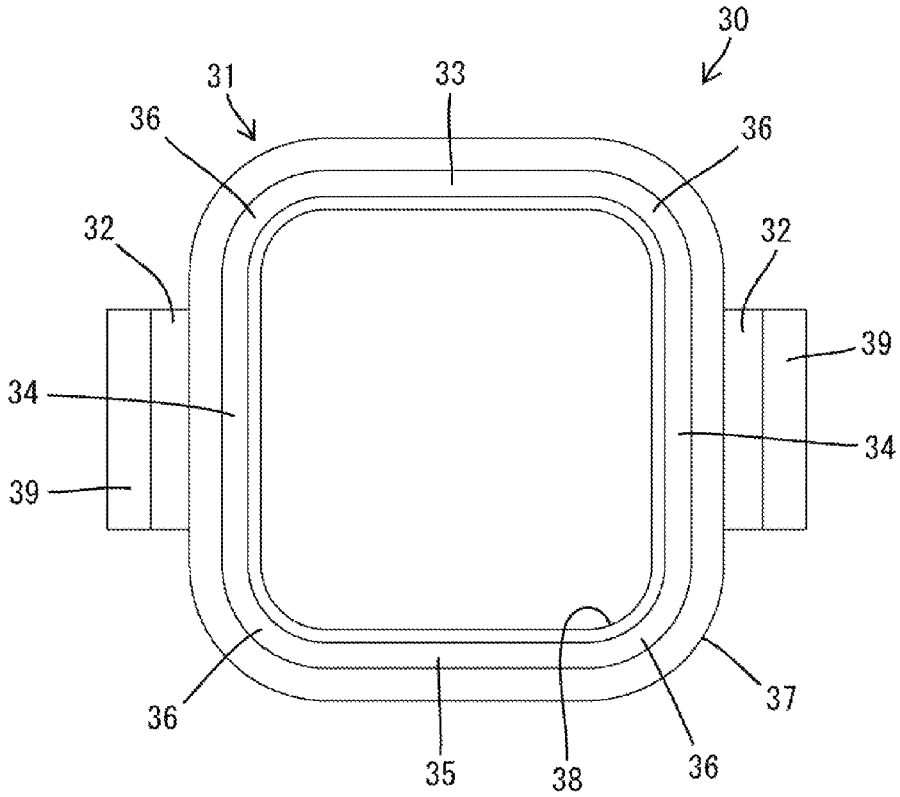
FIG. 6 is a front view of the seal ring.
Figure 7:
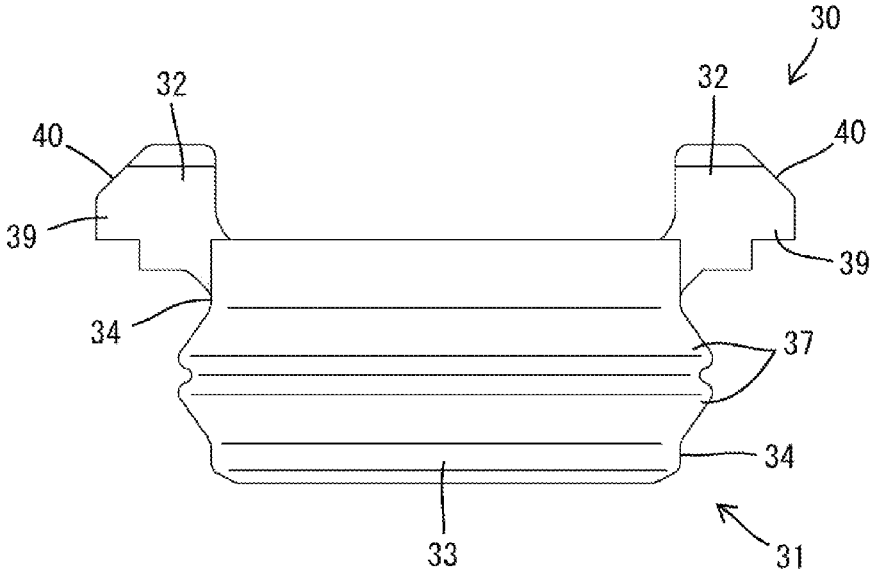
FIG. 7 is a plan view of the seal ring.
Figure 8:
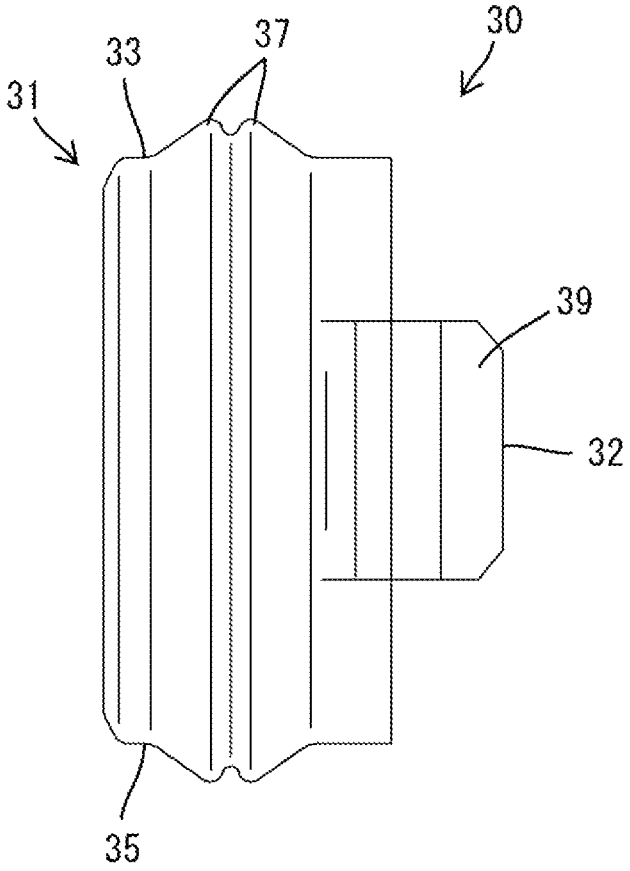
FIG. 8 is a side view of the seal ring.

As shown in FIGS. 6, 7 and 8, the seal ring 30 is made unitarily of rubber and defines a seal functioning portion 31 and two bilaterally symmetric positioning projections 32. The seal functioning portion 31 has a non-circular ring shape corresponding to the outer periphery of the terminal accommodating portion 11. The seal functioning portion 31 is composed of an upper frame portion 33 extending straight in a lateral direction, a pair of left and right side frame portions 34 extending straight in a vertical direction, a lower frame portion 35 extending straight in the lateral direction and four arcuate frame portions 36 having a substantially quarter-circular shape and smoothly connecting the frame portions 33, 34 and 35.

Outer lips 37 are formed on the outer periphery of the seal functioning portion 31 and are held in close contact with the inner periphery of the receptacle of the mating connector in a liquid-tight manner by being resiliently deformed. An inner lip 38 is formed on the inner periphery of the seal functioning portion 31. The inner lip 38 is held in close contact with the sealing surface 17 of the terminal accommodating portion 11 in a liquid-tight manner by being resiliently deformed.

The positioning projections 32 are cantilevered obliquely out to the back from outer surfaces of the side frame portions 34 of the seal functioning portion 31 behind the outer lips 37. Thus, the positioning projections 32 are located laterally outward of the outer side surface of the seal functioning portion 31 and mostly behind the rear end surface of the seal functioning portion 31. Accordingly, the rear ends of the positioning projections 32 (front ends in the mounting direction of the seal ring 30 onto the housing 10) are located behind the rear end of the seal functioning portion 31. Further, locks 39 are formed on the projecting end edges of the positioning projections 32 and project out in the lateral direction. Taper surfaces 40 are formed on the rear surfaces of the locks 39.

The seal ring 30 is mounted into the housing 10 from the front so that the two positioning projections 32 fit into the two positioning recesses 26. The positioning recesses 26 are open on the front end of the tubular fitting 12 so that an operator can visually confirm the positions of the positioning recesses 26. Further, the positioning projections 32 are formed with the taper surfaces 40. Hence, even if the seal ring 30 is displaced in the lateral direction with respect to the housing 10, such a displacement can be corrected by the taper surfaces 40.

Figure 3:
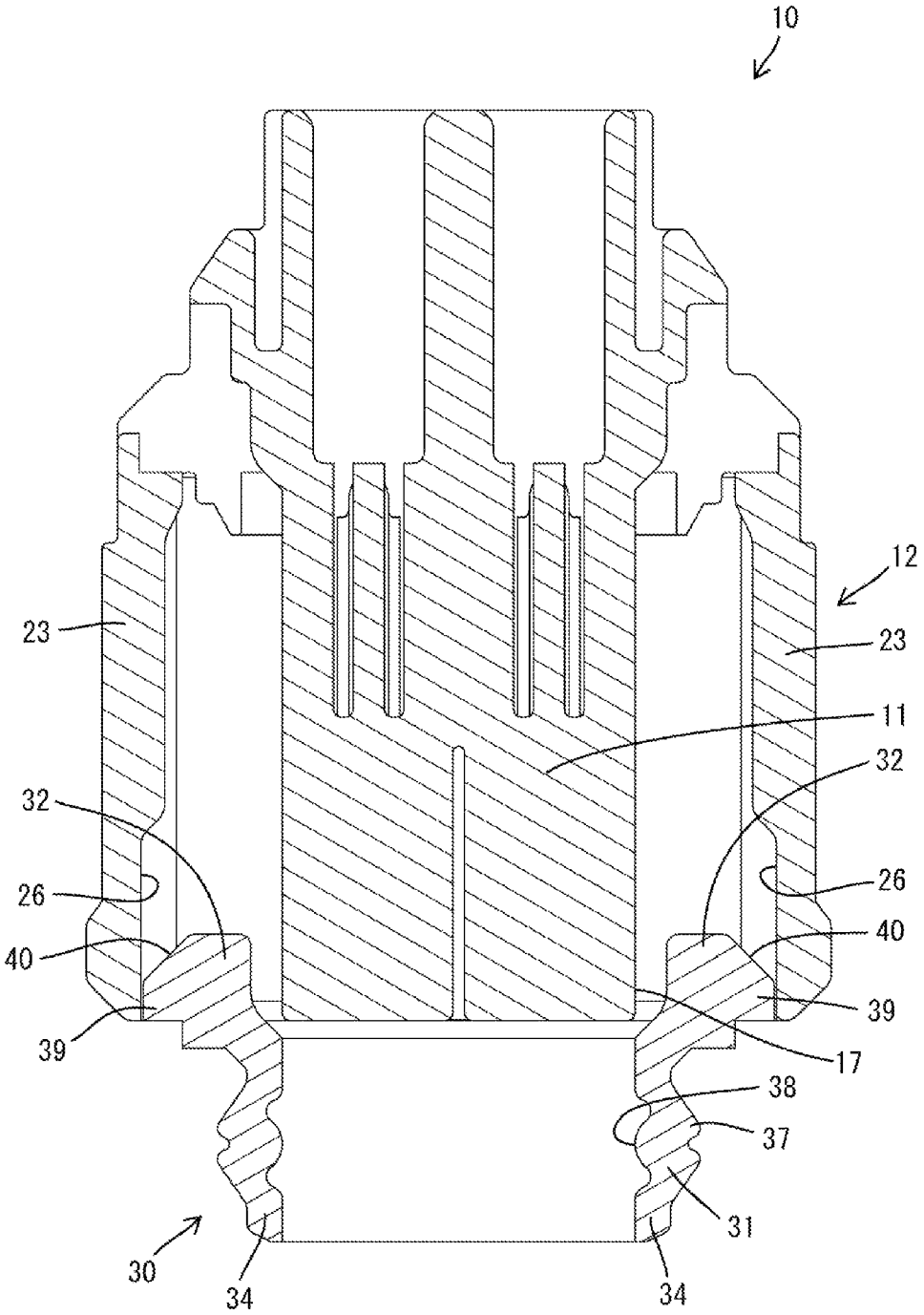
FIG. 3 is a plan view in section showing a state where positioning portions are fit in positioning recesses at an initial stage of mounting a seal ring.

The seal ring 30, including the positioning projections 32, is not resiliently deformed in a state where the positioning projections 32 are fit properly in front end parts of the positioning recesses 26. As shown in FIG. 3, the outer surfaces of the locks 39 on positioning projections 32 are held in contact with the inner surfaces of the positioning recesses 26 so that the seal ring 30 is positioned in the lateral direction with respect to the housing 10. Further, the upper and lower end surfaces of the positioning projections 32 are held in contact with the upper and lower inner surfaces of the positioning recesses 26. As a result, the seal ring 30 is positioned in the vertical direction with respect to the housing 10. These several contact positions are in a relationship to be different from each other in the circumferential direction along the outer periphery of the terminal accommodating portion 11.

Accordingly, the seal ring 30 is positioned in the circumferential direction with respect to the housing 10 by fitting the positioning projections 32 into the positioning recesses 26. If the seal ring 30 is positioned, the frame portions 33, 34 and 35 extending in the lateral or vertical directions are held in a positional relationship corresponding to the flat surfaces 18, 19, 20 without corresponding to the arcuate surface portions 21. Further, the arcuate frame portions 36 are in a positional relationship corresponding to the arcuate surfaces 21 without corresponding to the flat surfaces 18, 19 and 20.

Figure 4:
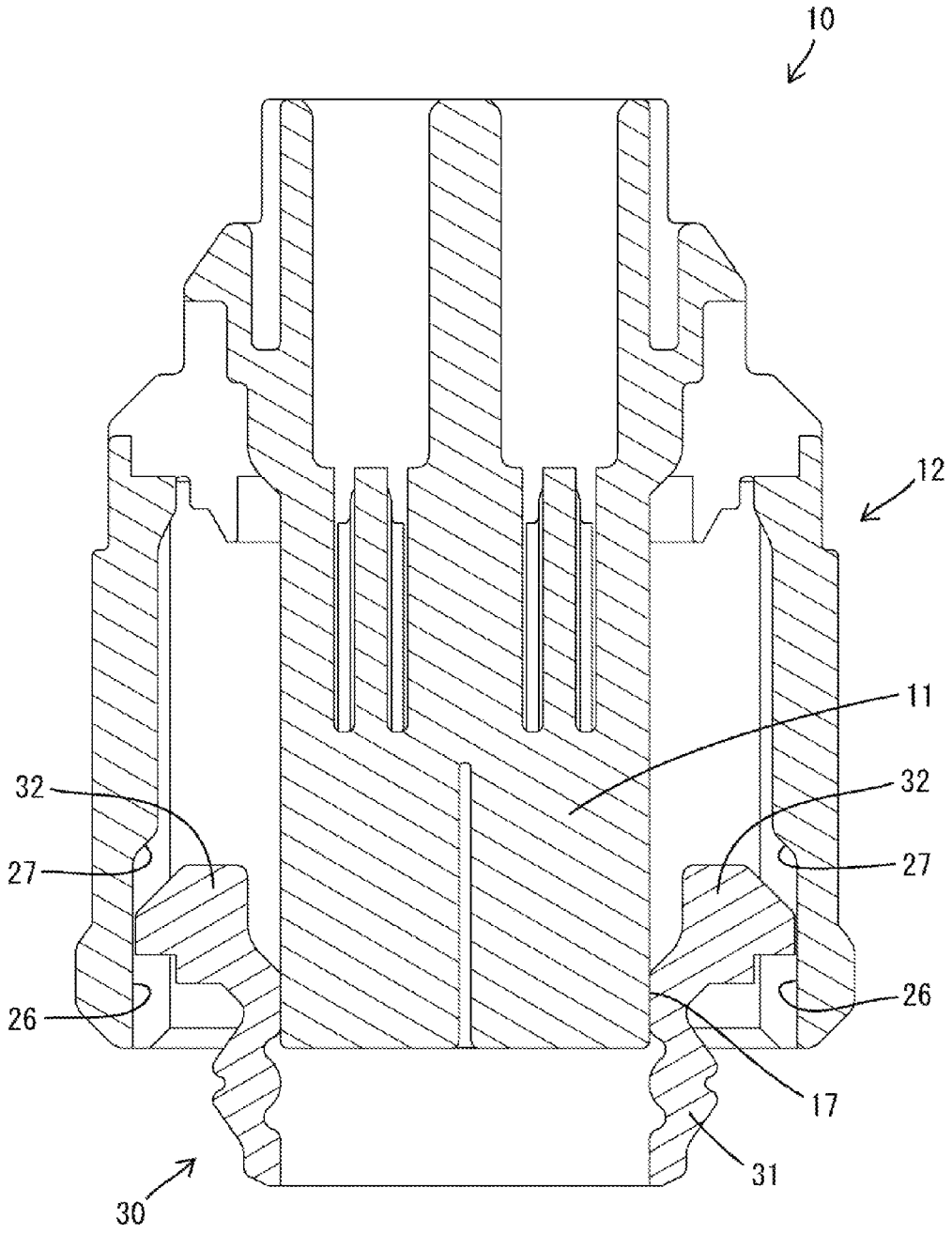
FIG. 4 is a plan view in section showing a state where the seal ring is further mounted in the state of FIG. 3 and a seal functioning portion is in contact with the outer periphery of a terminal accommodating portion.

The properly positioned seal ring 30 is mounted further so that the two positioning projections 32 are pushed from the front by a jig so that the seal ring 30 moves in parallel while sliding in contact with the sealing surface 17. When the seal ring 30 is mounted further, the seal functioning portion 31 is fit externally on a front end part of the outer peripheral sealing surface 17 of the terminal accommodating portion 11, as shown in FIG. 4. Since the seal ring 30 already is positioned in the circumferential direction with respect to the housing 10 at this point of time, the upper, side and lower frame portions 33, 34 and 35 respectively correctly contact the upper, side and lower surfaces 18, 19 and 20 and the four arcuate frame portions 36 respectively correctly come into contact with the corresponding arcuate surface portions 21.

In this state, the seal ring 30 is mounted further while being moved in parallel. In this mounting process, the taper surfaces 40 on the rear ends of the positioning projections 32 slide in contact with the guiding slants 27 on the rear ends of the positioning recesses 26 so that the positioning projections 32 resiliently deform inward in the lateral direction and separate from the positioning recesses 26 without being caught. Thereafter, as the seal ring 30 is mounted further, the positioning projections 32 slide in contact with the inner surfaces of the side walls 23 of the tubular fitting 12.

Figure 5:
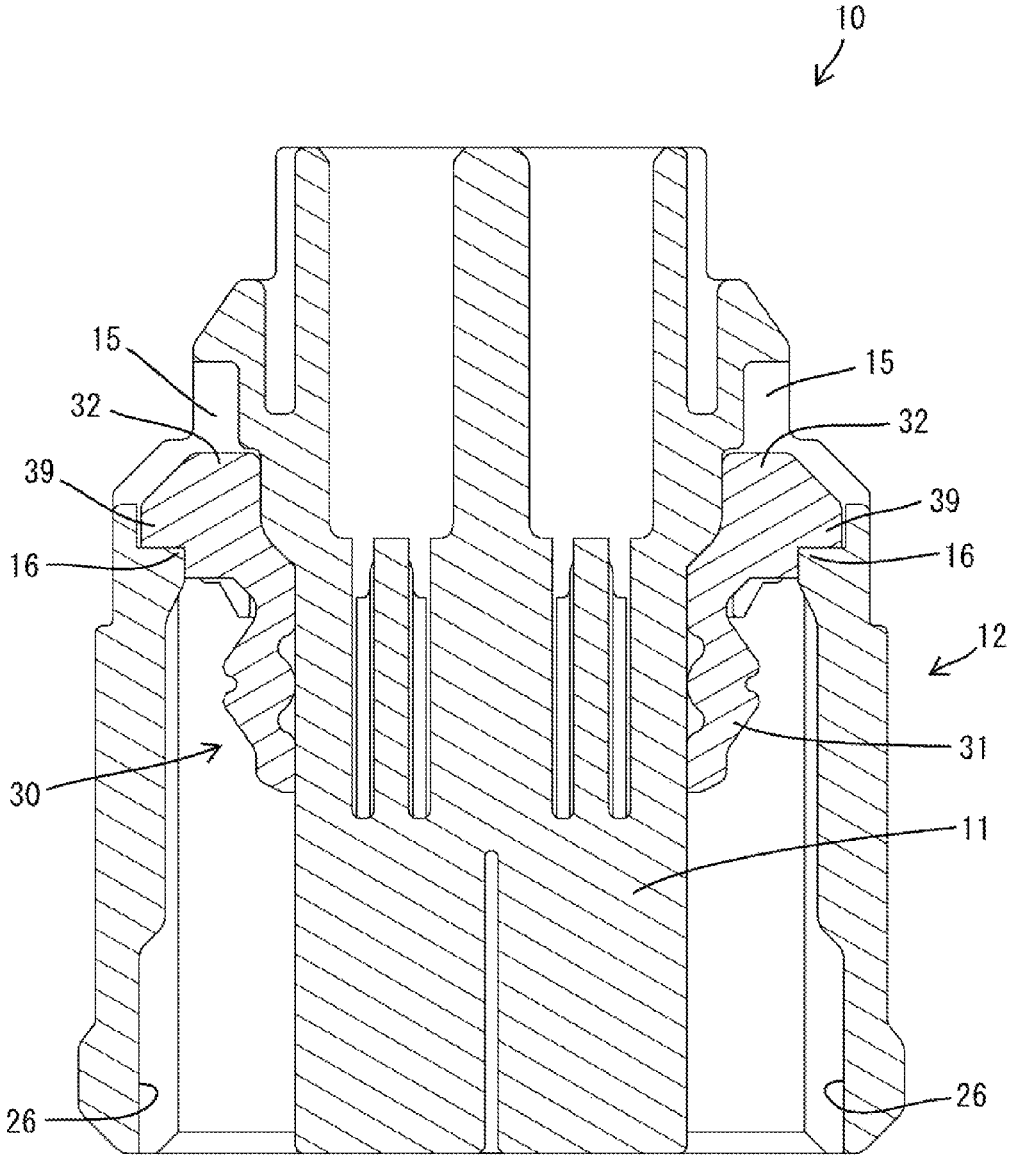
FIG. 5 is a plan view in section showing a state where the seal ring is completely mounted in the housing.

When the seal functioning portion 31 reaches a back end part of a fitting recess and the mounting of the seal ring 30 is completed, the positioning projections 32 fit into the holding portions 15 and the locking projections 39 engage with the locking portions 16 from behind as shown in FIG. 5. By this locking action, a forward detaching movement of the seal ring 30 from the housing 10 is restricted. In this way, the seal ring 30 is held in the mounted state to be correctly positioned in the circumferential direction and correctly positioned also in forward and backward directions.

The connector of this embodiment includes the housing 10 formed such that the terminal accommodating portion 11 has a non-circular outer periphery and is surrounded by the tubular fitting 12. The seal ring 30 is to be accommodated into the tubular fitting 12 from the front of the housing 10 and is mounted on the outer periphery of the terminal accommodating portion 11. The positioning projections 32 are formed on the seal ring 30 and the positioning recesses 26 are formed on the inner periphery of the front end part of the tubular fitting 12 to position the seal ring 30 in the circumferential direction by engaging the positioning projections 32 at the initial stage of mounting the seal ring 30.

According to this configuration, the positioning projections 32 are fit into the positioning recesses 26 at the initial stage of mounting the seal ring 30 so that the seal ring 30 is positioned in the circumferential direction. If the seal ring 30 is positioned at the initial mounting stage, the positioned seal ring 30 only has to be pushed straight back thereafter. Thus, there is no possibility that the seal ring 30 is displaced in the circumferential direction in the mounting process after the positioning. Therefore, a reduction in sealing performance due to a circumferential displacement can be prevented. Further, since the seal ring 30 is located near the front end part of the tubular fitting 12 at the initial mounting stage, visual position confirmation and positioning are easy and operability is excellent.

Further, the seal ring 30 includes the ring-shaped seal functioning portion 31 to be held in close contact with the outer peripheral surface of the terminal accommodating portion 11 and a positional relationship between the positioning projections 32 and the positioning recesses 26 is so set that the positioning projections 32 are fit into the positioning recesses 26 before the seal functioning portion 31 comes into contact with the outer periphery of the terminal accommodating portion 11 in the mounting process of the seal ring 30. According to this configuration, the entire seal ring 30 already is positioned in the circumferential direction when the seal functioning portion 31 is mounted on the outer periphery of the terminal accommodating portion 11. Thus, it is not necessary to correct the position of the seal ring 30 in the circumferential direction after the seal functioning portion 31 is mounted on the terminal accommodating portion 11.

Further, the connector includes the rear wall 13 connecting the rear end part of the tubular fitting 12 to the outer periphery of the terminal accommodating portion 11 and the holding portions 15 formed on the rear wall 13 and configured to hold the seal ring 30 in the mounted state by being engaged with the positioning projections 32. According to this configuration, the positioning projections 32 also have a function of holding the seal ring 30 in the mounted state, so that the shape of the seal ring 30 can be simplified as compared with the case where a special means for holding the seal ring in the mounted state is formed in addition to the positioning portions.

The present invention is not limited to the above described and illustrated embodiment. For example, the following embodiments are also included in the technical scope of the present invention.

Although the formation areas of the positioning recesses in forward and backward directions are only the front end parts of the tubular fitting in the above embodiment, the positioning recesses may be continuously formed from the front end (opening end) to the rear end (back end) of the tubular fitting.

Although the two positioning recesses are formed in the above embodiment, one, three or more positioning recesses may be formed.

Although the positioning projections are fit into the positioning recesses before the seal functioning portion comes into contact with the outer periphery of the terminal accommodating portion in the mounting process of the seal ring in the above embodiment, there is no limitation to this. The positioning projections may be fit into the positioning recesses after the seal functioning portion comes into contact with the outer periphery of the terminal accommodating portion.

Although the positioning projections also have the function of holding the seal ring in the mounted state in the above embodiment, the seal ring may be formed with a special means for holding the seal ring in the mounted state in addition to the positioning projections.

What is claimed is:

1. A connector, comprising:

a housing with a terminal accommodating portion having a non-circular outer periphery and a tubular fitting surrounding the terminal accommodating portion;

a seal ring accommodated in the tubular fitting from a front end of the housing and mounted on the outer periphery of the terminal accommodating portion;

at least one positioning projection formed on the seal ring; and at least one positioning recess formed on an inner periphery of a front end part of the tubular fitting and configured to position the seal ring in a circumferential direction by engaging the positioning projection at an initial stage of mounting the seal ring.

2. The connector of claim 1, wherein:

the seal ring includes a ring-shaped seal functioning portion to be held in close contact with the outer peripheral surface of the terminal accommodating portion; and a positional relationship between the positioning projection and the positioning recess is so set that the positioning projection is fit into the positioning recess before the seal functioning portion comes into contact with the outer periphery of the terminal accommodating portion when mounting the seal ring.

3. The connector of claim 2, further comprising:

a rear wall connecting a rear end part of the tubular fitting to the outer periphery of the terminal accommodating portion; and at least one holding portion formed on the rear wall and configured to hold the seal ring in a mounted state by engaging the positioning projection.

4. The connector of claim 1, wherein the at least one positioning projection comprises two positioning projections, and the at least one positioning recess comprises two positioning recesses.

5. The connector of claim 4, wherein the positioning projections and the positioning recesses are bilaterally symmetrically disposed.

6. The connector of claim 4, further comprising guiding slants formed on rear end parts of the positioning recesses.

7. The connector of claim 1, wherein the seal ring is formed unitarily of rubber.

* * * * *